US010032576B2

(12) United States Patent
Schmelzle et al.

(10) Patent No.: US 10,032,576 B2
(45) Date of Patent: Jul. 24, 2018

(54) OPERATOR CONTROL AND DETECTOR DEVICE HAVING DIFFERENTIATED SIGNAL GENERATION

(71) Applicant: Siemens Aktiengesellschaft, Munich (DE)

(72) Inventors: Daniel Schmelzle, Schaffhausen (CH); Stephan Spengler, Siblingen (CH)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 14/917,316

(22) PCT Filed: Sep. 16, 2013

(86) PCT No.: PCT/EP2013/069098
§ 371 (c)(1),
(2) Date: Mar. 8, 2016

(87) PCT Pub. No.: WO2015/036048
PCT Pub. Date: Mar. 19, 2015

(65) Prior Publication Data

US 2016/0225555 A1 Aug. 4, 2016

(51) Int. Cl.
*H01H 1/06* (2006.01)
*H01H 13/79* (2006.01)
(Continued)

(52) U.S. Cl.
CPC ..... *H01H 13/79* (2013.01); *H01H 1/20* (2013.01); *H01H 13/64* (2013.01); *H01H 2239/078* (2013.01)

(58) Field of Classification Search
CPC ..... H01H 13/79; H01H 1/20; H01H 13/64; H01H 2239/078
(Continued)

(56) References Cited

U.S. PATENT DOCUMENTS 3,842,230 A * 10/1974 Kashio ..... H01H 1/242 200/276
4,249,056 A 2/1981 MacManus
(Continued)

FOREIGN PATENT DOCUMENTS

CN 1379423 A 11/2002
CN 101620945 1/2010
(Continued)

OTHER PUBLICATIONS

Office Action dated Nov. 30, 2016 which issued in the corresponding Chinese Patent Application No. 201380077764.4.

*Primary Examiner* — Edwin A. Leon
*Assistant Examiner* — Lheiren Mae A Caroc
(74) *Attorney, Agent, or Firm* — Cozen O'Connor

(57) ABSTRACT

A command and signaling device responsive to movement of an actuating tappet includes a spring element to which the tappet is operatively connected to compress the spring element in response to movement of the tappet. A plurality of contact pads are defined on the surface of a printed circuit board. The spring element has a conical portion that is mounted on the printed circuit board proximate the contact pads, and a cylindrical part to which the tappet is connected. As the tappet movably advances, it drives the spring element into increasingly compressed positions that are sensed by contact of the spring element conical portion with multiple ones of the contact pads so that the spring element provides monitoring contact in a first compression position, a command and messaging signal in a second compression position and return urgency for return movement of the tappet.

8 Claims, 3 Drawing Sheets

(51) Int. Cl.
*H01H 13/64* (2006.01)
*H01H 1/20* (2006.01)

(58) Field of Classification Search
USPC ..... 200/276, 276.1
See application file for complete search history.

(56) References Cited

U.S. PATENT DOCUMENTS 4,529,848 A * 7/1985 Cherry ..... H03K 17/972
200/276.1
4,584,444 A * 4/1986 Nagashima ..... H03K 17/975
200/276.1
4,733,036 A * 3/1988 Koizumi ..... H01H 13/705
200/276.1
6,239,393 B1 * 5/2001 Hansen ..... F16F 1/08
200/276

FOREIGN PATENT DOCUMENTS

| | | |
|---|---|---|
| CN | 101866770 | 10/2010 |
| CN | 202205624 | 4/2012 |
| DE | 9405419 U1 | 6/1994 |
| JP | H0227627 A | 1/1990 |

* cited by examiner

OPERATOR CONTROL AND DETECTOR DEVICE HAVING DIFFERENTIATED SIGNAL GENERATION

FIELD OF THE INVENTION

The present invention is directed to a command and signaling device that includes an actuating tappet which is operatively connected to a spring element that is mounted on a printed circuit board.

BACKGROUND OF THE INVENTION

Modular command and signaling devices include a command device that can be implemented as, for example, a rotary knob, pushbutton or emergency off switch, a holder apparatus that fastens the command device at the installation location, and a module. Modules can be, for example, lighting modules, switching elements or so-called command and signaling modules. The signal that is generated by the module is forwarded via a cable connection from module to module via a gateway to a programmable logic controller (PLC) that evaluates the signal.

A mechanism within the device is configured for movement by the command device being actuated, for example when the command device is pushed or turned. At the end of the chain of action, the movement of the actuating element of the device is forwarded to an actuating element of the module. The mechanism within the module opens or closes a contact point.

The existing technical solutions for signal generation, such as a microswitch or contact block, comprise a contact, an actuating tappet, a return element and a mating contact as the auxiliary component. These elements must be provided in a twin configuration to integrate a monitoring contact.

OBJECTS AND SUMMARY OF THE INVENTION

It is an object of the invention to provide a command and signaling device that allows signal generation in an arrangement that is as simple and reliable as possible.

In accordance with the invention, this object is achieved by a command and signaling device that includes an actuating tappet which is operatively connected to a spring element, the spring element being mounted on a printed circuit board. The invention is distinguished over prior art devices in that a plurality of contact pads are arranged between the printed circuit board and the spring element, such that the contact pads convert different compression positions of the spring element into different signals.

The essence of the invention is that a plurality of, preferably three, contact pads, for example in the form of concentric rings, are arranged on a printed circuit board. The shape of the pads is however secondary to the invention, and segmented rings or, instead, strips are also feasible. The central contact point is the basis here. Since the forces of the spring element, that is to say of the contact spring, are higher during signal generation, the contact reliability of the signal contact is increased owing to the selection of the central contact pad as the basis.

In the unstressed starting position of the spring element, which preferably has a conical portion and a cylindrical portion, the spring element is located above the pads on the printed circuit board and initially makes contact either only with the outer pad geometry or not with any pad at all.

If the spring element then reaches a first compression position, in which it is compressed by means of a tappet, the outer turn of the spring element first makes contact with the outer pad geometry. If the spring element is then compressed further, the spring turns likewise make contact with the central pad. A current can then flow between the two pads via the spring element. This first compression position forms the so-called monitoring contact. In the process, it is determined whether a device is in the intended position, or the point at which the device is moved from or has left that position is determined.

If the spring element is compressed still further, it reaches a second compression position. In this case, the spring element also makes contact with the inner pad geometry. The current now flows between the central pad and the inner pad and also between the inner pad and the outer pad via the spring element. However, contact with the inner pad is associated with the possibility of a command and message signal now being generated.

It is also possible for the preferably conical part of the spring element to be completely compressed. The actuating tappet can be pushed further, wherein the preferably cylindrical part of the spring element is now further compressed, without changes to the switching signal. In addition, the spring element also takes on the function of a return element for the actuating tappet.

The contact spring of the invention thus combines in a single component a monitoring contact, a signal generating contact and a return element. Moreover, the spring can be pushed further after the monitoring signal and the contact signal are generated. The signal system of the spring can therefore be individually matched to the actuating paths. In addition, the switching points can be freely defined owing to the geometry of the spring and the arrangement of the contact pads on the printed circuit board. From an economics perspective, the integration of a plurality of functional elements in a single component provides the potential for considerable cost savings.

In a particularly advantageous illustrative embodiment of the invention; the spring element has a conical part and a cylindrical part. In this case, the conical part of the spring element forms the contact region with the contact pads. The cylindrical part of the spring element is configured for mounting in a recess in the actuating tappet and therefore can reliably transmit any change in position of the actuating tappet.

In a further advantageous illustrative embodiment of the invention, the contact pads are configured as concentric rings. The geometry of the contact pads thus matches the conical part of the spring element. The correspondence between the geometries of the spring element and of the contact pads allows for reliable contact-connection between the spring element and the contact pads.

A further exemplary embodiment of the invention is realized when the spring element has three functions—i.e., of a monitoring contact in the first compression position, of a command and message signal in the second compression position, and of a return element for the actuating tappet. This has, in particular, economic advantages since, in this case, a plurality of functional elements are integrated in a single component and there is accordingly the potential for considerable cost savings.

The command and signaling device of the invention includes a housing in which the actuating tappet is mounted. The actuating tappet is operatively connected to the spring element that preferably has a conical part and a cylindrical part. The cylindrical part is mounted in a recess in the actuating tappet. The conical part of the spring element is mounted on a printed circuit board that includes contact pads, preferably in the form of concentric rings, arranged between the printed circuit board and the conical part of the spring element. In the unstressed starting position of the spring element, the spring element is located above the contact pads on the printed circuit board and makes contact only with the outer pad geometry or does not make contact with any of the pads.

In the first compression position, the spring element is compressed by means of the tappet and the outer turn of the spring element initially makes contact with the outer pad geometry. If the spring element is further compressed, the spring turns likewise make contact with the central pad. A current can now flow between the two pads via the spring element. This first compression position of the spring element corresponds to the monitoring contact. In the process, it is determined whether a command and signaling device is in the intended position.

If the spring element according to the invention is then still further compressed, the spring element additionally makes contact with the inner pad geometry and the second compression position is reached. The current now flows between the central pad and the inner pad and also between the inner pad and the outer pad, all via the spring element. A command or message signal can be generated by contact being made with the inner pad.

The contact spring in accordance with the invention combines a monitoring contact, a signal generating contact and a return element in a single component. In addition, the spring element can be pushed or displaced further after the monitoring signal and the contact signal are generated. The signal system of the spring element can therefore be individually matched to the actuating paths. Moreover, the switching points can be freely defined owing to the geometry of the spring element and the arrangement of the contact pads on the printed circuit board. By virtue of the integration of a plurality of functional elements in a single component, this solution provides the potential for considerable cost savings.

Further advantages and embodiments of the invention will be explained below with reference to an exemplary embodiment and with reference to the drawings.

DETAILED DESCRIPTION OF THE PREFERRED EMBODIMENTS

Figure 1:
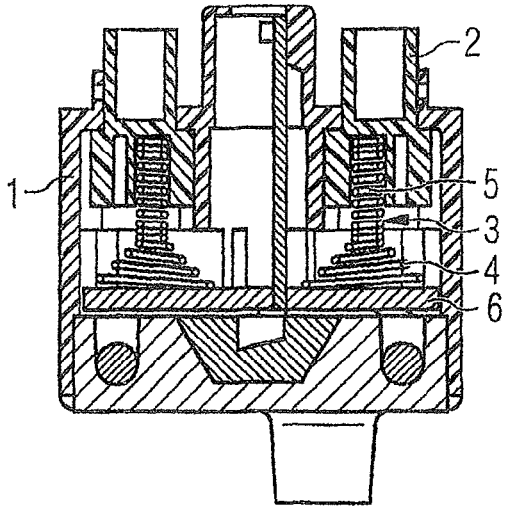
FIG. 1 is a sectional side view of a command and signaling device constructed in accordance with the invention and including an actuating tappet, a spring element and a printed circuit board.

FIG. 1 depicts a command and signaling device in accordance with the invention and having a housing 1 in which an actuating tappet 2 is mounted. The actuating tappet 2 is operatively connected to a spring element 3 which preferably has a conical part 4 and a cylindrical part 5. The cylindrical part 5 is mounted in a recess of the actuating tappet 2. The conical part 4 of the spring element 3 is mounted on a printed circuit board 6.

Figure 2:
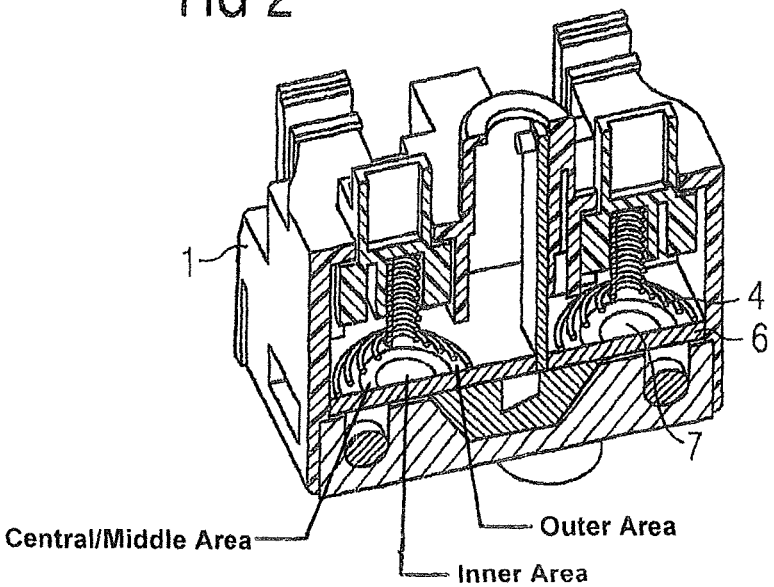
FIG. 2 is an elevated perspective sectional view of the command and signaling device of FIG. 1 with the contact pads positioned between the spring element and the printed circuit board.

FIG. 2 correspondingly shows the command and signaling device of FIG. 1, wherein contact pads 7 that are preferably in the form of concentric rings are arranged between the printed circuit board 6 and the conical part 4 of spring element 3. As should be apparent in FIG. 2, the command and signaling device has a plurality of contact pads 7, the spacing between the contact pads being matched to the individual spring rings of the conical part 4 of spring element 3.

Figure 3:
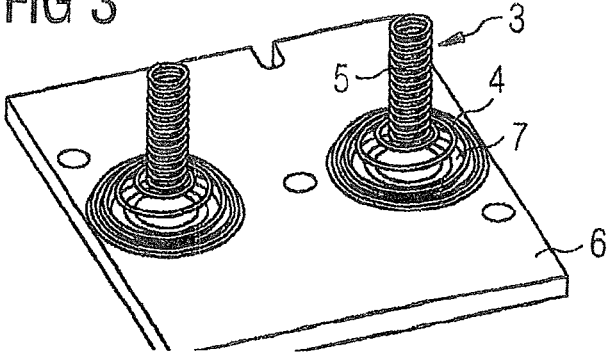
FIG. 3 is an elevated perspective view depicting the positioning of a spring element of the invention on the contact pads of a printed circuit board.

FIG. 3 depicts the spring element 3 of the invention including the conical part 4 and the cylindrical part 5, the spring element being arranged on corresponding contact pads 7 of a printed circuit board 6.

Figure 4:
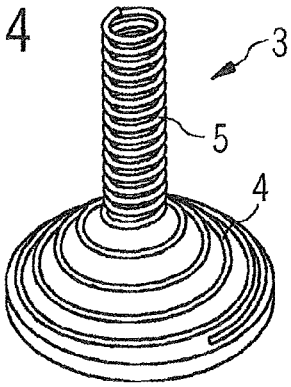
FIG. 4 is an elevated perspective view of an exemplary embodiment of a spring element of the invention in its unstressed starting position.
Figure 5:
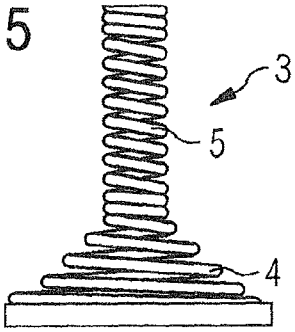
FIG. 5 is a side view of the spring element of FIG. 4 in the unstressed starting position.

FIG. 4 shows an exemplary embodiment of the spring element 3 in its unstressed, starting or initial position, and FIG. 5 depicts a corresponding side view of spring element 3. In this unstressed starting position, the spring element is located above the contact pads 7 on the printed circuit board 6 and makes contact only with the outer pad geometry or does not make contact with any of the pads 7.

Figure 6:
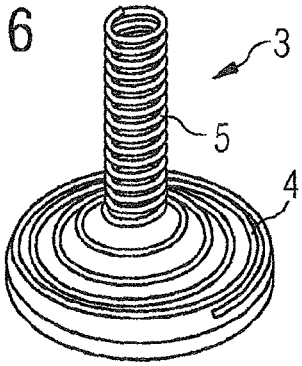
FIG. 6 is an elevated perspective view of a spring element according to the invention in the first compression position.
Figure 7:
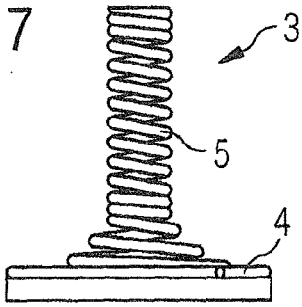
FIG. 7 is a side view of the spring element of FIG. 6 in the first compression position.

FIGS. 6 and 7 depict, in respective elevated perspective and side views, the spring element 3 in a first compression position. When spring element 3 is compressed from its starting position by means of actuating tappet 2, the outer turn of the spring element initially makes contact with the outer pad geometry. If the spring element is then further compressed, the spring turns likewise make contact with the central pad. An electrical current can then flow between the two contact pads via the spring element.

Figure 8:
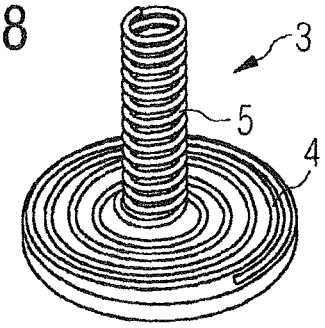
FIG. 8 is an elevated perspective view of a spring element according to the invention in the second compression position.
Figure 9:
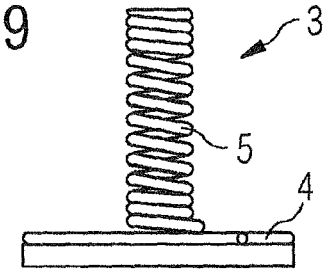
FIG. 9 is a side view of the spring element of FIG. 8 in the second compression position.

FIGS. 8 and 9 show, in respective elevated perspective and side views, spring element 3 in the second compression position. As spring element 3 is compressed further from its first compression position, the spring element also makes contact with the inner pad geometry. An electrical current can then flow between the central pad and the inner pad and also between the inner pad and the outer pad, all via the spring element. A command or message signal can be generated in response to such contact being made with the inner pad.

Figure 10:
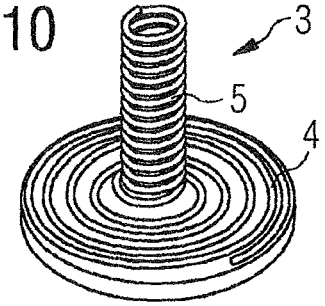
FIG. 10 is an elevated perspective view of a spring element according to the invention in a further compression position after the second compression position.
Figure 11:
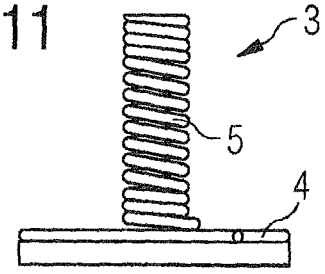
FIG. 11 is a side view of the spring element of FIG. 10 in the further compression position after the second compression position depicted in FIG. 10.

FIGS. 10 and 11 depict, in respective elevated perspective and side views, spring element 3 in a further compressed position after the second compression position—i.e. with continued compression of the spring element after the spring element has already attained its second compression position. The conical part 4 of spring element 3 is now completely compressed. The actuating tappet 2 can now be pushed or advanced further, whereby the cylindrical part 5 of spring element 3 is further compressed, without changing the switching signal.

The contact spring in accordance with the invention combines the functions of a monitoring contact, a signal generating contact and a return element in a single component. Moreover, the spring element can be pushed or advanced further after the monitoring signal and the contact signal are generated. The signal system of the spring element can accordingly be individually matched to the actuating paths. In addition, the switching points can be freely defined owing to the geometry of the spring element and the arrangement of the contact pads on the printed circuit board. By virtue of the integration of a plurality of functional elements in a single component, this solution provides the potential for considerable cost savings.

The invention claimed is:

1. A command and signaling device, comprising:

a printed circuit board;

a spring element mounted on the printed circuit board;

an actuating tappet arranged for movement and operatively connected to the spring element to compress the spring element with movement of the actuating tappet; and a plurality of contact pads arranged between the printed circuit board and the spring element for converting different compressed positions of the spring element into different signals;

wherein the spring element includes three functions comprising a first function in which the spring element is compressible into a first compression position such that contact with the plural contact pads is monitored and a second function in which the spring is compressible into a second compression position such that a command and message signal is generated;

wherein the first compression position of the spring element is reached when the spring element is in contact with a respective outer and middle area of a pad of the plurality of contact pads; and wherein the second compression position is achieved when the spring element is in contact with an inner area of the pad of the plurality of contact pads.

2. The command and signaling device of claim 1, wherein the spring element comprises a conical part and a cylindrical part.

3. The command and signaling device of claim 1, wherein the plural contact pads comprise concentric rings.

4. The command and signaling device of claim 1, wherein the spring element defines a return urgency for positionally returning the actuating tappet after movement of the actuating tappet.

5. The command and signaling device of claim 1, wherein the third function of the three functions comprises a return element.

6. The command and signaling device of claim 1, wherein the third function of the substantially linear movement comprises a return element.

7. A command and signaling device, comprising:

a printed circuit board;

a plurality of contact pads carried on the printed circuit board;

an actuating tappet arranged for displacement in advancing and return orientations through a range of substantially linear movement; and a spring element comprising a cylindrical part connected to the actuating tappet and a conical part arranged proximate the plural contact pads, the conical part being compressible, in response to advancing movement of the actuating tappet through the range of substantially linear movement, into contact with at least one of the plural contact pads for generating signals denoting different compression positions of the spring element;

wherein said range of substantially linear movement includes three functions in which a first function comprises a first compression position at which contact with the plural contact pads is monitored and a second compression position at which a command and message signal denoting the different compression positions of the spring element is generated;

wherein the first compression position of the spring element is reached when the spring element is in contact with a respective outer and middle area of a pad of the plural contact pads; and wherein the second compression position is achieved when the spring element is in contact with an inner area of the pad of the plural contact pads.

8. The command and signaling device of claim 7, wherein the plural contact pads comprise concentric rings of an electrically conductive material, and wherein the spring element is formed of an electrically conductive material so that compression of the conical part of the spring element into contact with multiple ones of the plural contact pads effects electrical contact between and completes an electric signal circuit between said multiple ones of the plural contact pads.

* * * * *